US006920918B2

(12) United States Patent
Knecht et al.

(10) Patent No.: US 6,920,918 B2
(45) Date of Patent: Jul. 26, 2005

(54) HEAT EXCHANGER

(75) Inventors: Wolfgang Knecht, Stuttgart (DE); Roland Strähle, Untereneingen (DE); Jörg Soldner, Ehningen (DE); Walter Gühring, Filderstadt (DE); Rainer Kaissling, Filderstadt (DE); Harald Schatz, Teutlingen (DE); Andreas Stolz, Walddorfhäslach (DE)

(73) Assignee: Modine Manufacturing Company, Racine, WI (US)

( * ) Notice: Subject to any disclaimer, the term of this patent is extended or adjusted under 35 U.S.C. 154(b) by 115 days.

(21) Appl. No.: 10/402,899

(22) Filed: Mar. 28, 2003

(65) Prior Publication Data

US 2003/0196785 A1 Oct. 23, 2003

(30) Foreign Application Priority Data

Mar. 30, 2002 (DE) ..... 102 14 467

(51) Int. Cl.[7] ..... F28D 9/02
(52) U.S. Cl. ..... 165/157; 165/166; 165/173
(58) Field of Search ..... 165/148, 153, 165/157, 162, 166, 173

(56) References Cited

U.S. PATENT DOCUMENTS

| | | | | | |
|---|---|---|---|---|---|
| 3,545,062 | A | * | 12/1970 | Cox | 165/166 |
| 3,719,227 | A | * | 3/1973 | Jenssen | 165/166 |
| 3,757,856 | A | * | 9/1973 | Kun | 165/166 |
| 3,847,211 | A | * | 11/1974 | Fischel et al. | 165/166 |
| 4,131,159 | A | * | 12/1978 | Long | 165/166 |
| 4,384,611 | A | * | 5/1983 | Fung | 165/166 |
| 4,470,455 | A | * | 9/1984 | Sacca | 165/153 |
| 4,967,835 | A | * | 11/1990 | Lefeber | 165/167 |
| 5,036,911 | A | * | 8/1991 | So et al. | 165/153 |
| 2001/0018970 | A1 | * | 9/2001 | Nakado et al. | 165/174 |
| 2002/0023734 | A1 | * | 2/2002 | Wagner | 165/153 |
| 2002/0043361 | A1 | * | 4/2002 | Saito et al. | 165/153 |
| 2002/0148602 | A1 | * | 10/2002 | Nakamura | 165/165 |
| 2003/0024696 | A1 | * | 2/2003 | Haplau-Colan et al. | 165/153 |

FOREIGN PATENT DOCUMENTS

| | | |
|---|---|---|
| DE | 3601588 | 7/1987 |
| DE | 4307503 | 9/1994 |
| DE | 4333904 | 3/1995 |
| DE | 19836889 | 2/2000 |
| DE | 10011954 | 9/2001 |
| DE | 10124383 | 1/2002 |

* cited by examiner

*Primary Examiner*—Teresa J. Walberg
(74) *Attorney, Agent, or Firm*—Wood, Phillips, Katz, Clark & Mortimer

(57) ABSTRACT

An economically manufactured heat exchanger is provided and includes a plurality of elongated, straight, flat tubes (16), each formed of two identical halves (78,80) joined to each other in mirror image fashion and each having opposed open ends and all arranged in a stack (18). At least one spacer wall (36) is disposed within each tube and extends generally from end to end thereof to define at least two side-by-side first fluid flow paths within a tube. An elongated housing (10) contains the stack and includes spaced headers (20,22) with each header including a tube slot for the adjacent end of each tube (16) in the stack (18). Spacers (26) in the stack separate adjacent tubes in the stack from one another and the spacers include ribs defining a serpentine flow path for a second fluid. An opening (30) is located in the housing (10) near each end thereof and is in fluid communication with the second fluid flow path (28).

13 Claims, 4 Drawing Sheets

HEAT EXCHANGER

FIELD OF THE INVENTION

This invention relates to heat exchangers generally, and more specifically, to an exhaust gas heat exchanger for use in exhaust recirculation systems for internal combustion engines.

BACKGROUND OF THE INVENTION

Heat exchangers useable in exhaust gas recirculation systems used with internal combustion engines, typically in vehicles, are known. One such heat exchanger is shown, for example, in German Patent Publication DE 101 24 383. While such heat exchangers work well for their intended function, heretofore, they have been constructed in a relatively expensive design that may lack flexibility, particularly where two exhaust channels are required.

The present invention is directed to providing a heat exchanger, and more particularly, the heat exchanger that may be utilized in an exhaust recirculation system that is economically fabricated and which can be readily utilized as a single channel or a multiple channel exhaust gas heat exchanger.

SUMMARY OF THE INVENTION

It is the principal object of the invention to provide a new and improved heat exchanger that may utilized in many heat exchange applications and which additionally is particularly suited for use in an exhaust gas recirculation system for internal combustion engines.

An exemplary embodiment of the invention envisions a heat exchanger that includes a plurality of elongated, straight, flat tubes. Each tube is formed of two identical halves joined to each other in mirror image fashion and each has opposed open ends. All of the tubes are arranged in a stack.

At least one spacer wall is disposed within each tube and extends generally from end to end thereof to define at least two side-by-side first fluid flow paths within each tube. Also provided is an elongated housing that contains the stack and which includes a header at each of two opposed ends. Each header includes a tube slot for the adjacent end of each tube in the stack and is sealed to each such adjacent end. Each header further is sealed to a corresponding end of each spacer wall in each tube in the stack and tube spacers are disposed in the stack separating adjacent tubes in the stack from one another and separating endmost tubes in the stack from the housing to define a second fluid flow path around the tubes and between the endmost tubes and the housing. The tube spacers include ribs defining a serpentine flow path for the second fluid. An opening is disposed in the housing near each end thereof and is in fluid communication with the second fluid flow path.

In a preferred embodiment, the tube halves are thin, channel-shaped plates or sheets having a base and the tube spacers are defined by deformations in the base.

Preferably, the tube spacers include small, nominally frusto-conical deformations in addition to the ribs.

In a preferred embodiment, each spacer wall comprises an elongated bar.

In one embodiment of the invention, a connection flange is located at each header.

In one embodiment, each connection flange and the corresponding header are integral.

In another embodiment, each connection flange and the corresponding header are plates in flush contact with each other and are joined together.

In a highly preferred embodiment, each connection flange has an opening spanned by braces that enter the second fluid flow path between the flat tubes at each end of the stack and which is sealed thereto.

In a highly preferred embodiment, the tube spacers are distributed along the entire length of each tube.

In one embodiment, the ribs are elongated and have a length less than the distance from an edge of each tube to the spacer wall therein and extend from the tube edge toward the spacer wall within the tube.

One embodiment of the invention contemplates that the openings in the housing wall are defined by slits in at least one wall of the housing and that there be a connection fitting sealed to the housing about each the slits.

In a highly preferred embodiment, each tube half is a thin, elongated, channel-shaped plate or sheet having a wide base and spaced, relatively short legs on each edge of the base. Each of the legs terminates in an outwardly directed flange defining a bonding area.

In a highly preferred embodiment of the invention, each outwardly directed flange has a plurality of outwardly extending tabs deformed over and engaging the adjacent outwardly directed flange of another tube half used to form each of the tubes.

Other objects and advantages will become apparent from the following specification taken in connection with the accompanying drawings.

DESCRIPTION OF THE PREFERRED EMBODIMENTS

The heat exchanger forming the invention hereof will described as a heat exchanger intended for use in an exhaust gas recirculation system for an internal combustion engine. However, those skilled in the art will recognize that it is susceptible to other uses as well and no limitation is intended to its use solely as an exhaust gas heat exchanger except as expressly stated in the appended claims. For example, the invention is susceptible to use wherever heat exchange between two fluids is required as, for example, as a liquid/gas heat exchanger.

Figure 1:
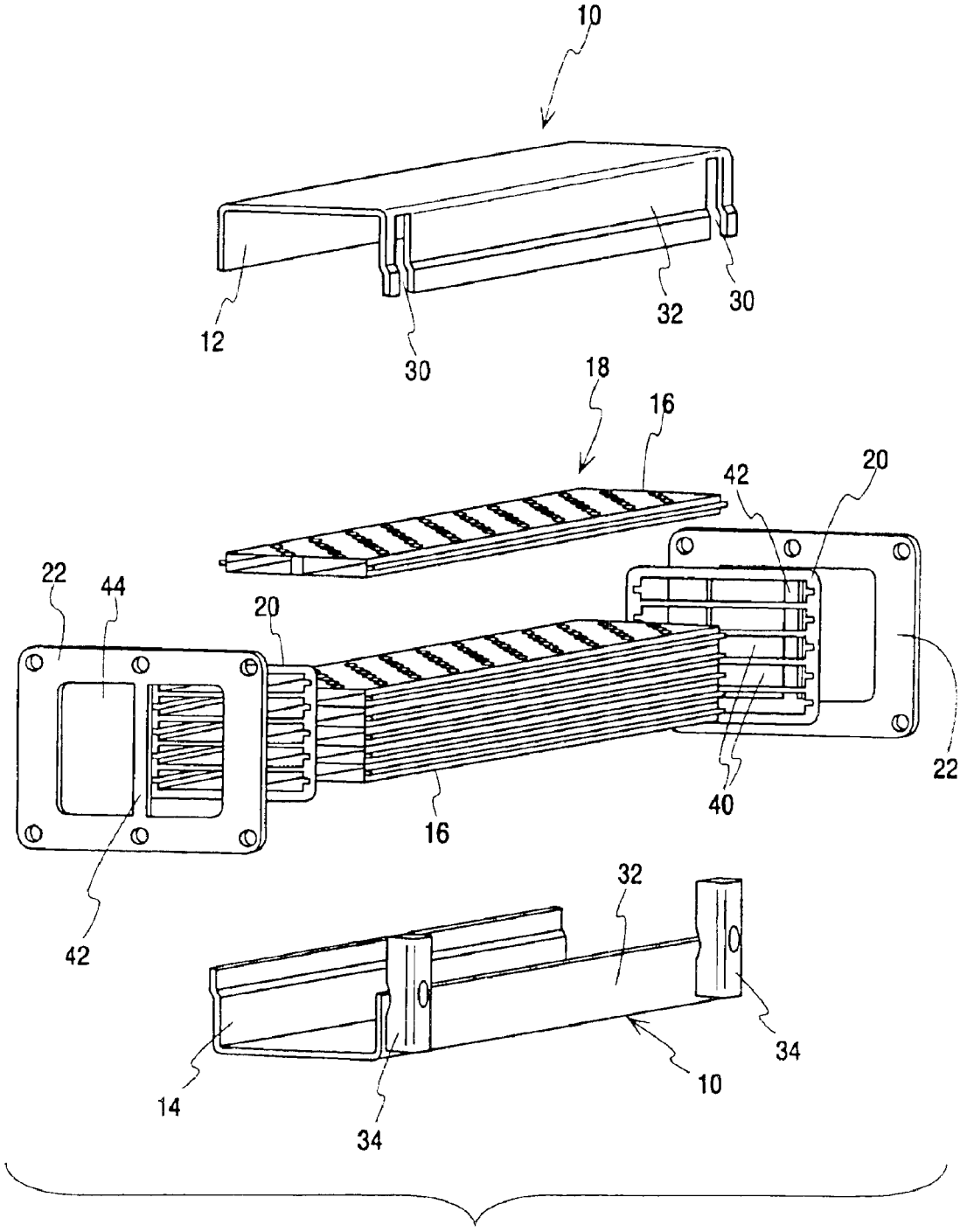
FIG. 1 is an exploded view of an exemplary embodiment of the invention.

Referring now to the drawings, and FIG. 1 in particular, an exemplary embodiment of a heat exchanger made according to the invention is illustrated therein and is seen to include a housing, generally designated 10, made up of a top half 12 and a bottom half 14 which are substantially identical to each other.

Contained within the housing is a plurality of elongated, flat, tubes 16, arranged in a stack, generally designated 18. The tube stack 18 is provided with headers 20 at opposite ends of the tubes 18 which in turn are fitted with connection flanges 22, again at opposite ends of the housing 10.

Figure 2:
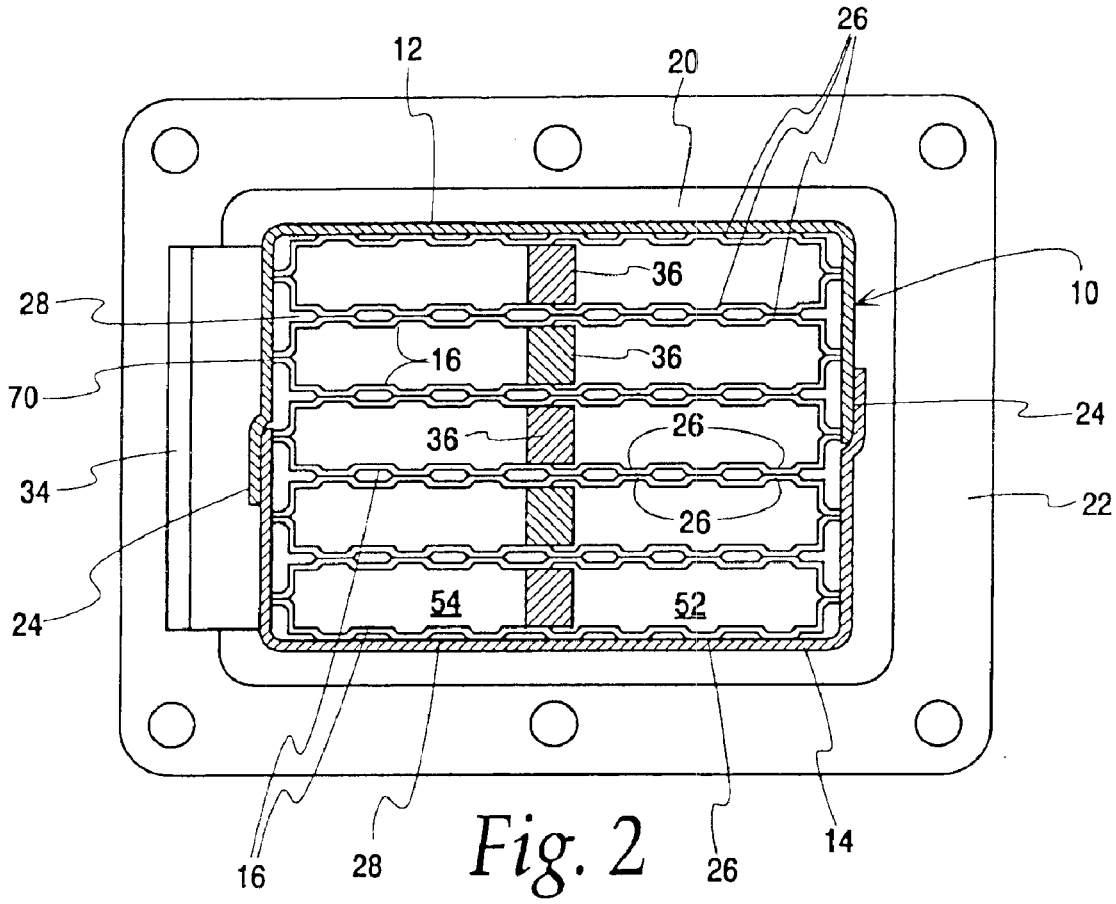
FIG. 2 is a sectional view taken transverse to the length of the heat exchanger between the ends thereof.

Referring to FIG. 2, the upper and lower housing parts 12 and 14 are seen to have identical cross sections and are fitted together at stepped flanges 24 at the approximate midpoints of their side walls. The tubes 16 are disposed within the housing in a stack 18 as mentioned previously and are formed in a manner to be described hereinafter. For purposes of FIG. 2, and as can be somewhat fragmentarily seen in FIG. 1, the flat sides of each tube 16 extending along the tube major dimension is provided with a plurality of spacers in the form of deformations or embossments 26. The embossments 26 are aligned so that they abut at the interface of two adjacent tubes. At the top and bottom tubes 16 in the stack, the embossments 26 abut the top and bottom walls of the housing 10. As a consequence, a fluid flow path about the entirety of the exterior of the tubes 16 is established and such flow path also is immediately adjacent all of the interior walls of the housing 10.

To establish fluid communication with the flow path 28, as best seen in FIG. 1, though only shown in connection with the housing part 12, both of the housing parts 12 and 14 are provided with slots 30 near their opposite ends in a side wall 32 thereof. The slots 30 thus provide flow openings to the interior of the housing 10 and connection fittings 34 are bonded to the housing 10 over the slots 30 to provide a means of connecting the heat exchanger into a fluid flow system.

Returning to FIG. 2, a preferred embodiment of the invention contemplates that each of the tubes 16 be provided with at least one spacer bar 36 extending along its entire length. The spacer bars 36, in the embodiment illustrated, thus divide each tube 16 into two independent flow channels.

In some cases, in lieu of the solid spacer bars 36, those skilled in the art will appreciate that the same thing could be accomplished by forming suitable ribs in the flat walls of each tube 16 which engage and are bonded to one another. However, spacer bars are preferred since the use of ribs or other spacer wall constructions requiring deformation of the tubes 16 may make it more difficult to obtain reliable sealing of the tubes at the headers 20 and connection flanges 22.

Figure 3:
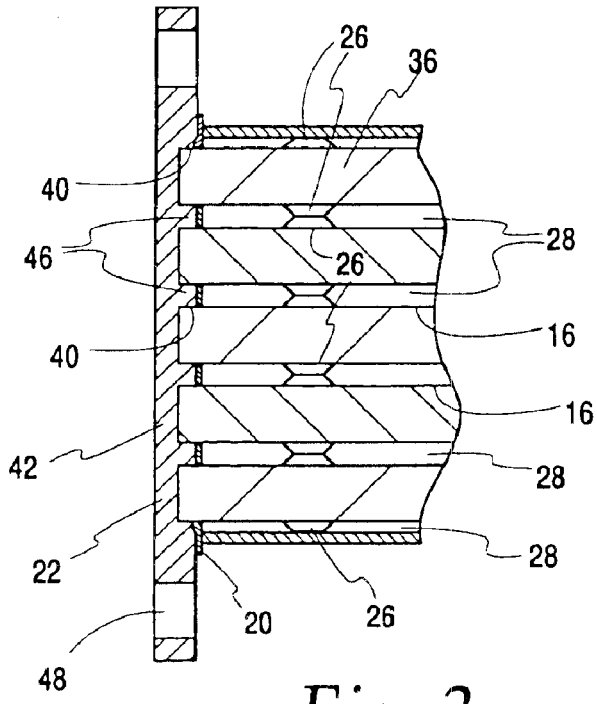
FIG. 3 is an enlarged, fragmentary sectional view taken parallel to the elongation of the heat exchanger.

Referring to FIGS. 1 and 3, each header 20 is seen to comprise a relatively thin plate or sheet and includes a plurality of tube slots or openings 40 in which the ends of the tubes 16 are received. As illustrated in the right hand part of FIG. 1, the openings 40 extend generally horizontally and include an interruption 42 that is generally vertical and which aligns with the spacer bars 36 within the tubes.

The headers 20 may be integrally formed with the connection flanges 22 or may be flushly mounted thereagainst and bonded thereto.

As seen in FIG. 1, each connection flange includes a brace 42 that divides an opening in the connection flange through which fluid within the tubes may flow. As seen in FIG. 3, the brace 42 includes a plurality of relatively short ribs 46 which extend into the housing flow path 28 at both ends thereof about the ends of the tubes 16 at the location of the spacer bars 36. The brace 42 and the ribs 46 thereon provide good reinforcement for the header 20.

Each connection flange 42 also is provided with a series of openings 48 for receipt of threaded fasteners or the like whereby the heat exchanger, and in particular, the flow path defined by the tubes 16, may be connected into a fluid flow path of a heat exchange system.

Figure 4:
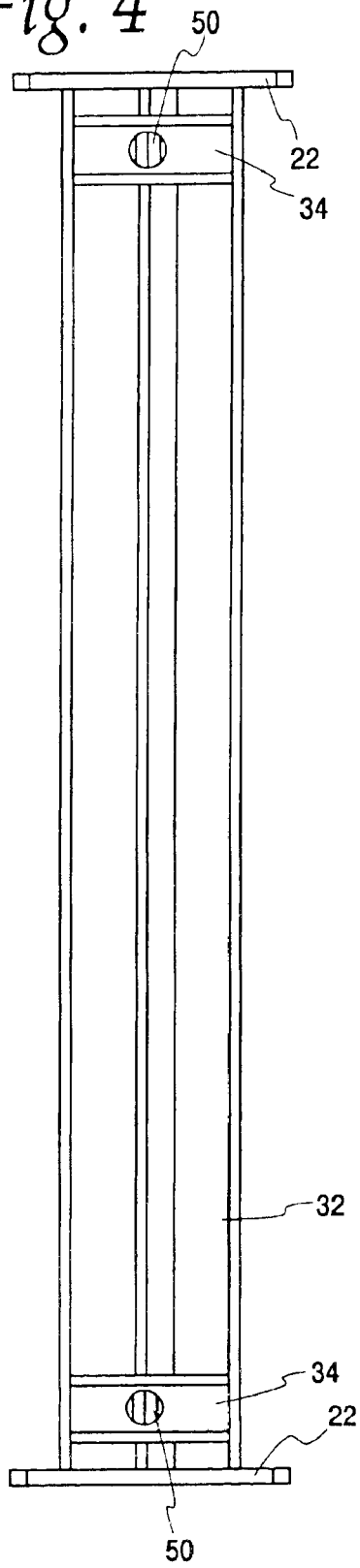
FIG. 4 is a side elevation of the heat exchanger.

FIG. 4 illustrates a completed heat exchanger made according to the invention standing on one of the connecting flanges 22. It will observed that the fixtures 34 are provided with openings 50 for receipt of conduits to connect the other flow path within the heat exchanger, namely, the housing flow path 28 into the flow system.

Figure 5:
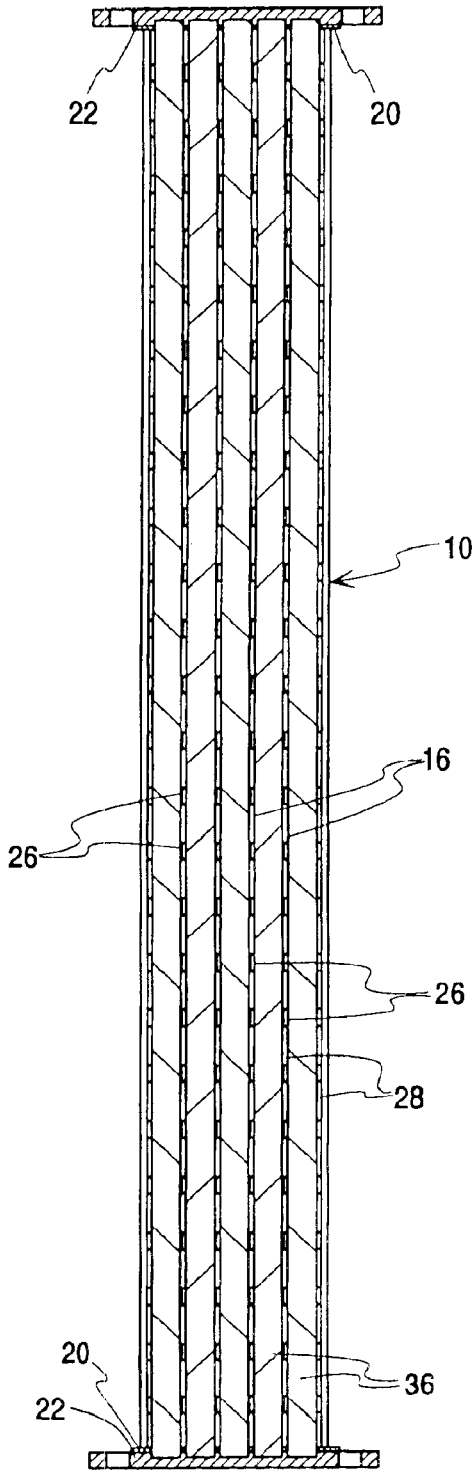
FIG. 5 is a sectional view taken from end to end of the heat exchanger.

FIG. 5 is a sectional view, again with the completed heat exchanger made according to the invention standing on the one of the connection flanges 22. It will be seen that the tubes 16 are straight and thereby define a straight flow path within the interior of the tubes 16 from one end of the heat exchanger to the other to minimize internal pressure drop. It can be also be appreciated from FIG. 5 that the deformations or embossments 26 which serve as the tube spacers between adjacent tubes and between endmost tubes in the stack and the housing 10 are uniformly distributed along the length of the tubes 16.

Figure 6:
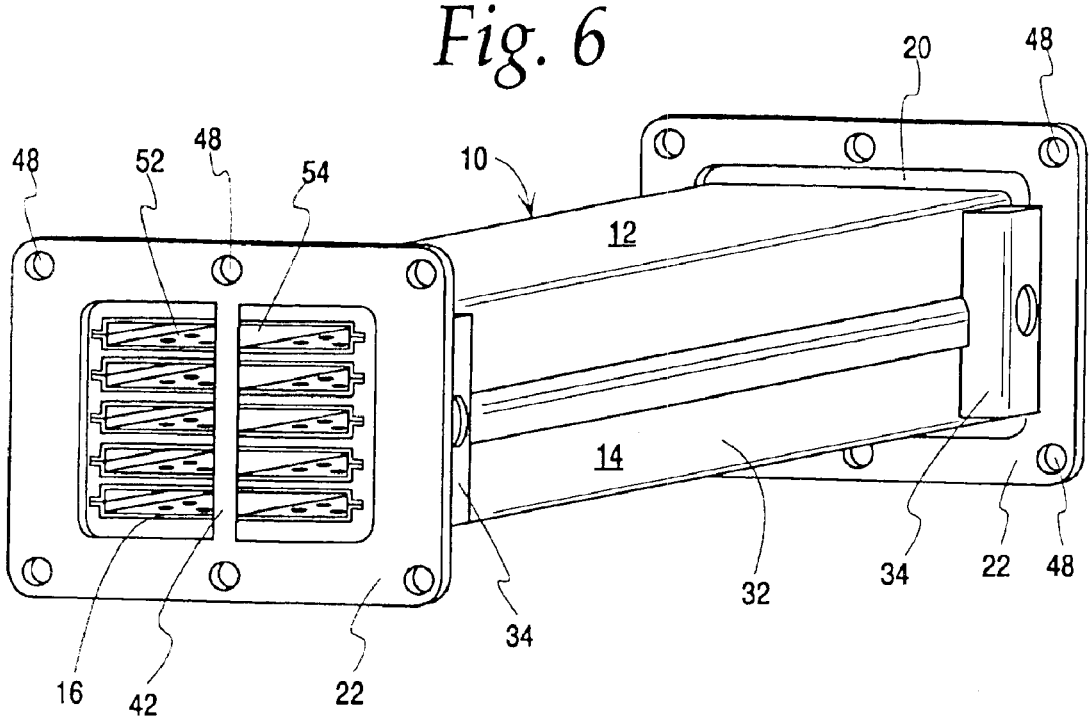
FIG. 6 is a perspective view of the heat exchanger.

FIG. 6 shows a heat exchanger in perspective and it will be appreciated that, as is apparent from both FIG. 6 and FIG. 2, that the interior of each tube 16 is divided into two, side-by-side flow paths 52 and 54.

Figure 7:
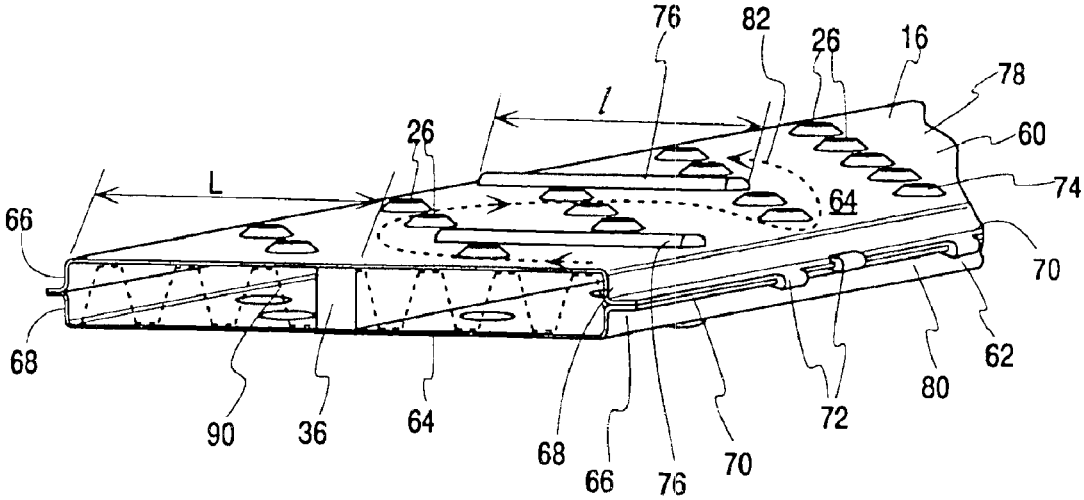
FIG. 7 is an enlarged, fragmentary view of one of the elongated tubes used in the exemplary embodiment of the invention.

FIG. 7 illustrates, in greater detail, one of the tubes 16. The same is made of two identical, channel-shaped halves 60 and 62. Each tube half includes a relatively wide, flat base 64 having relatively short upstanding legs 66 and 68 at each edge. Each leg 66, and 68, in turn, terminates in an outwardly directed flange 70 which, as seen in FIG. 2, may abut against the internal side wall of the housing 10. As the slots 30 (FIG. 1) extend substantially from top to bottom of the side wall 32 of the housing, the fact that the flanges 70 contact the interior of the side wall is of no moment to the fluid flow pattern between the tubes 16.

Outwardly directed tabs 72 extend from each flange 70 and are folded over the abutting flange 70 to hold the tube halves 60,62 in an assembled state for bonding at the bonding area defined by each of the flanges 70.

The embossments or deformation 26 take on two forms. In one form 74, the embossments are much like dots, that is to say, they are nominally frusto-conical in shape. In another form 76, the embossments are elongated ribs which extend from one of the legs 66 or 68 transversely of the length of each of the tubes 16 to about the location of the spacer bars 36.

It is a principal feature of the invention that the tubes 16 be formed of two identical halves 60 and 62 so that they may be abutted to define a tube by placing them in mirror image fashion against one another with the flanges 70 abutting each other and defining a bonding area whereat the tube halves 60 and 62 may be bonded and sealed together, as by brazing or the like. The arrangement is such that the tube spacers, whether in the form shown at 74 or the form shown at 76 align with and abut each other so that they too may be bonded to one another.

In the case of the tube spacers 76, they are staggered extending from one side leg 66,68 toward the center to define a serpentine flow path indicated by a dotted arrow 82 in FIG. 7. In low pressure applications, only the rib 76 may be used while in higher pressure applications, the frusto-conical embossments 74 may be employed as well.

Because of the symmetry involved, when the tube halves 78,80 are assembled as shown in FIG. 7, and placed in the stack 18, the spacers 74,76 on one tube will align with and abut the spacer 74,76 of the adjacent tube to create minimum spacing for the flow path 28. As noted above, the ribs 76 provide a flow directing function and the frusto-conical embossments 74 may provide a turbulating effect as well.

From the foregoing, it will be appreciated that a very cost effective heat exchanger is provided by the invention. The use of identical tubes halves to define the tubes 16 as well as identical housing halves 12,13 minimize the tooling required to construct the same. The heat exchanger can provide two or more independent side-by-side fluid flow paths within the tubes simply by the use of one or more spacer bars 36 within each tube. Because of the ability to provide multiple flow paths within each tube 16, the same is ideally suited for those vehicular exhaust gas recirculating systems that require plural channels since the channels 54 are isolated from the channels 52 and may be set up as part of a separate flow path by appropriate connections to the connecting flanges 22 when the same is placed in the system.

Furthermore, if desired, a multipass flow system within the tube 16 could be provided simply by utilizing appropriate baffles at one or both of the headers 20 and connection flanges 22. The particular embodiment shown could be adapted to a two pass system simply by providing a baffle aligned with the spacer bars 36 separating an inlet to the flow channels 52 and an outlet from the flow channels 54 together with a cap or the like at the opposite connection flange 22 allowing fluid communication thereat between the flow channels 52 and 54. An even greater number of passes could be obtained by using an additional one or more spacer bars 36 within each one of the tubes 16.

If desired, turbulators or internal heat exchange enhancements, typically sinusoidal in shape, could be introduced into each of the flow channels 52 or 54 as schematically illustrated in dotted lines 90 in FIG. 7 where the increased pressure drop can be tolerated.

The fact that the flow path 28 extends all the way about the tubes 16 and between the endmost tubes 16 in the stack and the housing 10 assures that the housing 10 will remain relatively cool when the flow path 28 is used as a coolant flow path as would be typical in an exhaust gas recirculation system application.

The ribs 76 provide an excellent fluid directing means within the flow path 28 and to this end, as seen in FIG. 5, it is preferable that the ribs 76 have a length "l" no greater than the distance from the side wall 66,68 of each tube half 78,80 to the location of the spacer bars 36.

In general, many of the components, including the headers 20 may be clad with a braze alloy to facilitate assembly. Where parts are not susceptible to being readily clad with a braze alloy, braze paste or foils may be located at the brazing areas. This technique would be particularly useful if the connection flanges 22 are made of a stainless steel, for example, which is not readily susceptible to braze cladding. Paste or foil would facilitate joining the connection flanges 22 to the headers 20 when the two are separate or in joining an integral header 20 and connection flange 22 to housing 36 and to the tubes 26.

In addition, the unique use of the spacer ribs 76 to direct flow, in the described embodiment, provides a means whereby either concurrent/cross or countercurrent/cross flow may be obtained with the flow path 28 as desired.

What is claimed is:

1. A heat exchanger comprising:

a plurality of elongated straight flat tubes, each formed of two identical halves joined to each other in mirror image fashion, each having opposed open ends and all arranged in a stack;

at least one spacer wall within each tube and extending generally from end to end thereof to define at least two side-by-side first fluid flow paths within each tube;

an elongated housing containing said stack, including a header at each of two opposed ends, each said header including a tube slot for the adjacent end of each tube in the stack, and sealed to each said adjacent end, each said at least one spacer wall having opposite ends sealed to said housing;

tube spacers in said stack separating adjacent tubes in said stack from one another and endmost tubes in said stack from said housing to define a second fluid flow path around said tubes and between said endmost tubes and said housing, said tube spacers including ribs defining a serpentine flow path for said second fluid; and an opening in said housing near each end thereof and in fluid communication with said second fluid flow path.

2. The heat exchanger of claim 1 wherein said tube halves are thin, channel-shaped plates or sheets having a base, said tube spacers being defined by deformations in said base.

3. The heat exchanger of claim 1 wherein said tube spacers include small, nominally frusto-conical deformations in addition to said ribs.

4. The heat exchanger of claim 1 wherein each said spacer wall comprises an elongated bar.

5. The heat exchanger of claim 1 further including a connection flange at each header.

6. The heat exchanger of claim 5 wherein each connection flange and the corresponding header are integral.

7. The heat exchanger of claim 5 wherein each connection flange and the corresponding header are placed in flush contact with each other and joined together.

8. The heat exchanger of claim 5 wherein each connection flange has an opening spanned by braces that enter the second fluid flow path between the flat tubes at each end of the stack and is sealed thereto.

9. The heat exchanger of claim 1 wherein said tube spacers are distributed along the entire length of each tube.

10. The heat exchanger of claim 1 wherein said ribs are elongated and have a length less than the distance from an edge of each tube to the spacer wall therein and extend from said tube edge toward the spacer wall within the tube.

11. The heat exchanger of claim 1 wherein said openings are defined by a slit in at least one wall of said housing, and a connection fitting sealed to said housing about each said slit.

12. The heat exchanger of claim 1 wherein each said tube half is a thin, elongated channel-shaped plate or sheet having a wide base and spaced, relatively short legs on each edge of said base, each said leg terminating in an outwardly directed flange defining a bonding area.

13. The heat exchanger of claim 12 wherein each flange has a plurality of outwardly extending tabs deformed over and engaging the adjacent flange of another tube half used to form each of said tubes.

* * * * *